United States Patent [19]

Daglow

[11] Patent Number: 4,766,641

[45] Date of Patent: Aug. 30, 1988

[54] DETENT CLUTCH FOR A VACUUM CLEANER

[75] Inventor: Terry D. Daglow, White Bear Lake, Minn.

[73] Assignee: Whirlpool Corporation, Benton Harbor, Mich.

[21] Appl. No.: 815,392

[22] Filed: Dec. 31, 1985

[51] Int. Cl.[4] ..... A47L 5/30

[52] U.S. Cl. ..... 15/390; 192/56 R; 464/37

[58] Field of Search ..... 15/390, 182; 464/37; 192/56 R, 76

[56] References Cited

U.S. PATENT DOCUMENTS

| | | | |
|---|---|---|---|
| 2,551,718 | 5/1951 | Auten | 464/37 X |
| 2,563,112 | 8/1951 | Hill et al. | 464/37 X |
| 3,724,815 | 4/1973 | Hawkins et al. | 464/37 X |
| 4,235,321 | 11/1980 | Stein | 15/390 X |
| 4,317,253 | 3/1982 | Gut et al. | 15/390 |
| 4,429,430 | 2/1984 | Lyman | 15/182 |

FOREIGN PATENT DOCUMENTS

| | | | |
|---|---|---|---|
| 2022199 | 12/1979 | United Kingdom | 464/37 |
| 846856 | 7/1981 | U.S.S.R. | 464/37 |

*Primary Examiner*—Chris K. Moore

*Attorney, Agent, or Firm*—Hill, Van Santen, Steadman & Simpson

[57] ABSTRACT

A clutch mechanism for use in the drive mechanism for a vacuum cleaner floor cleaning rotary brush is provided which prevents damage to the drive belt in the event the brush becomes jammed and is prevented from rotating. A cam ring having external bumps carried on resilient beams is nested inside a driven sprocket with the bumps positioned in valleys between ridges formed on the interior of the sprocket. A pair of end caps sandwich the assembly of the cam and sprocket. The cam is keyed to the rotary brush and thus when the brush becomes jammed, the sprocket will continue to rotate, and the torque applied between the sprocket and cam will cause the ridges to push radially inwardly against the bumps and beams of the cam permitting the bumps to pass over the ridges dissipating the energy of the rotating sprocket.

14 Claims, 1 Drawing Sheet

DETENT CLUTCH FOR A VACUUM CLEANER

BACKGROUND OF THE INVENTION

1. Field of the Invention

The present invention relates to torque limiting clutches and in particular to a detent device for limiting the torque applied to the clutch in a vacuum cleaner rotating brush.

2. Description of the Prior Art

The present invention is useful in an upright vacuum sweeper which has a floor engagable brush dowel rotatably driven by a cog belt which engages a sprocket carried on the brush dowel. If the brush dowel becomes jammed such as by engagement with a sock or other article, a clutch mechanism permits the sprocket to slip with respect to the brush dowel to prevent damage to the cog belt. The vacuum sweeper includes a control circuit such as that disclosed in U.S. Pat. No. 4,370,690 to terminate operation of the motor driving the brush dowel in the event the sensed speed of the brush drops below a predetermined low speed.

However, if the control circuit were to fail, and then the brush dowel is jammed, the motor will not turn off. It would be desirable to prevent heat generated by friction within the clutch from reaching excessive temperatures. Since the brush dowel is oftentimes constructed of wood, any excessive heat could cause the wood to char or ignite.

Various types of clutches have been suggested in prior patents for driving a rotary brush in a vacuum cleaner. In U.S. Pat. No. 3,757,382 it is disclosed to use a pulley on the brush roller which has high and low friction areas so that the amount of friction of the driven pulley will be reduced relative to the friction of the drive pulley in order to enhance a slippage under overload conditions.

U.S. Pat. No. 4,317,253 discloses an override clutch device which has a spring member with a deformable end which is to be in contact with a boss on the driven pulley which will deform to permit the pulley to rotate relative to a jammed brush roller.

U.S. Pat. No. 4,532,667 discloses a clutch mechanism for connecting a brush assembly to a driven pulley which comprises a S-shaped spring having ends which engage with recesses in the interior of the pulley but which can be deformed away from the recesses upon the occurrence of a jammed brush.

SUMMARY OF THE INVENTION

The present invention provides a clutch mechanism for use in connecting a driven pulley with a rotatable brush dowel in a vacuum cleaner. The clutch mechanism comprises an outer pulley member which is engagable by a drive belt which has an interior opening defining a continuous series of bumps or ridges around the interior circumference of the pulley. An inner cam member has an interior opening which is received on the brush dowel and is prevented from rotating relative to the brush dowel by means of keys, flats or other arrangements. The cam has a plurality of radially extending spokes which are interconnected by flexible beams. At least one outwardly projecting bump is carried on each of the beams. When the inner cam is nested inside of the pulley, the bumps on the beams nest in valleys between the internal ridges of the pulley. The ridges are sufficiently tall to prevent the bumps from riding over the ridges unless sufficient torque is applied to relatively rotate the two parts in which case the beams will deflect slightly inwardly to permit the bumps to ride up the side of a ridge and to pass over the crest of the ridge to move to the next valley. In this manner, the energy and speed of the driven pulley is gradually dissipated.

The sprocket pulley and inner cam may be fabricated of material having silicone and teflon additives to function as lubricants for the system to facilitate relative movement between the inner cam and the sprocket in the event of a jam. The sprocket and inner cam parts yield and slip relative to each other in the event of a jam and are thus reusable.

DESCRIPTION OF THE PREFERRED EMBODIMENTS

Figure 1:
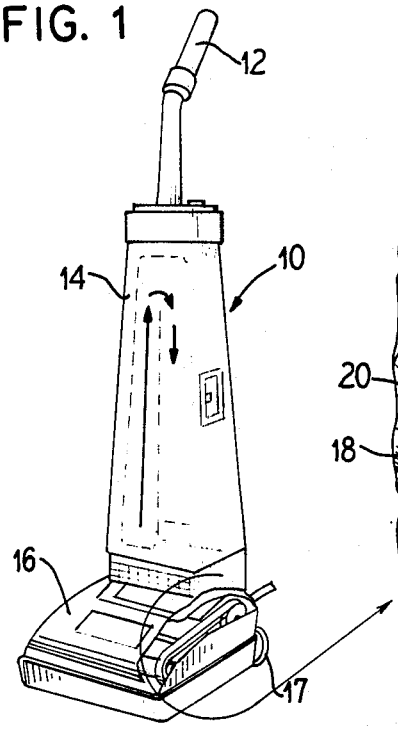
FIG. 1 is a perspective view of an upright vacuum sweeper embodying the principles of the present invention.

In FIG. 1 there is illustrated an upright vacuum sweeper or cleaner generally at 10 which includes at a top end a handle 12 to permit the user to manipulate the sweeper over a floor area to be cleaned. A dirt collecting compartment 14 is carried by the sweeper below the handle 12, but above a floor engaging portion or housing 16. A floor engaging housing 16 has a plurality of wheels 17 permitting the housing 16 to be rolled over a floor surface to be cleaned.

Figure 2:
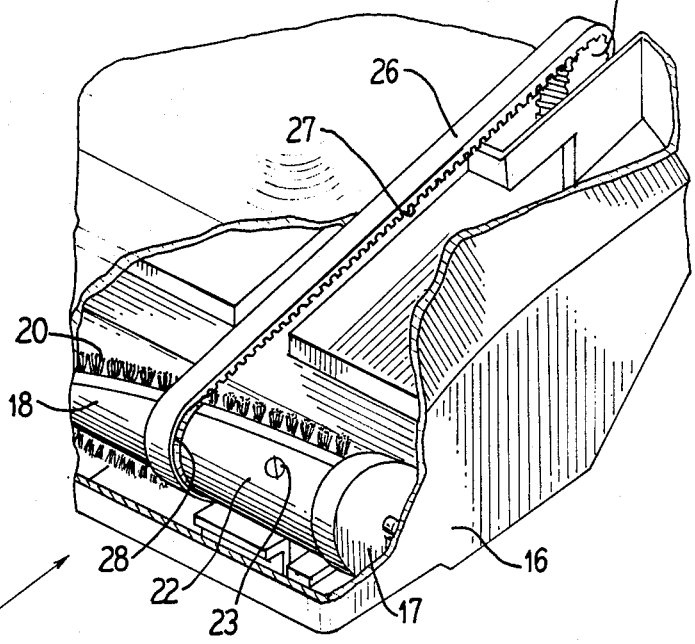
FIG. 2 is an enlarged partial perspective view, of the brush dowel and drive portion of the vacuum sweeper as indicated from FIG. 1.

A part of the floor engaging portion 16 is shown in greater detail in FIG. 2 which has been partially cut away to show a brush dowel 18 having helically arranged rows of bristles 20 for engaging the floor surface to be cleaned. An end portion 22 of the brush dowel is removable from the main portion of the brush dowel by removal of a locking screw 23 to assemble and maintain a clutch mechanism on the brush dowel. An electric motor (not visible) drives a drive pulley 24 which in turn drives a cog tooth belt 26. The cog belt 26 has a plurality of spaced teeth 27 on an inner surface thereof and engages with a pulley or sprocket 28 having external ridges 29 for meshing with the teeth 27 and which is carried on the brush dowel 18 between the main brush dowel portion and the removable end portion 22.

Figure 3:
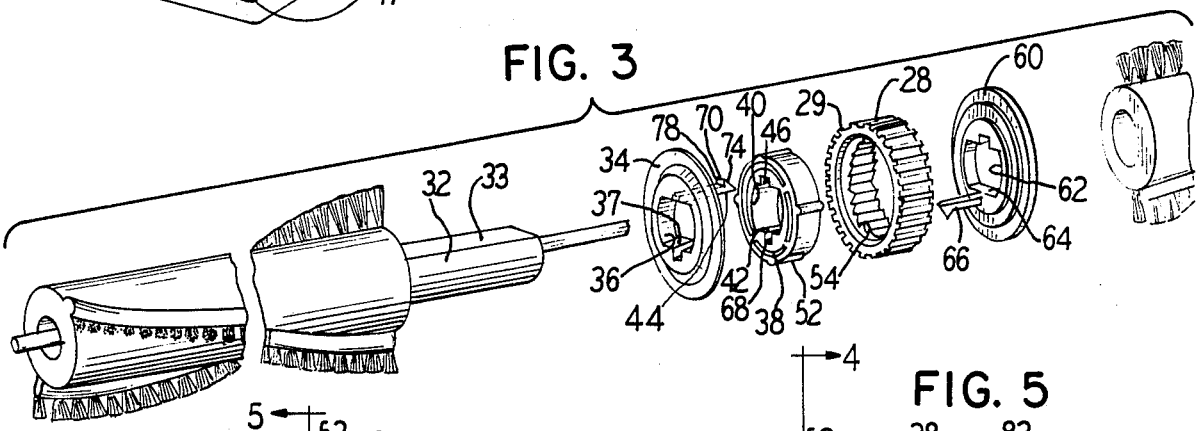
FIG. 3 is an exploded view of the brush dowel and clutch mechanism.
Figure 4:
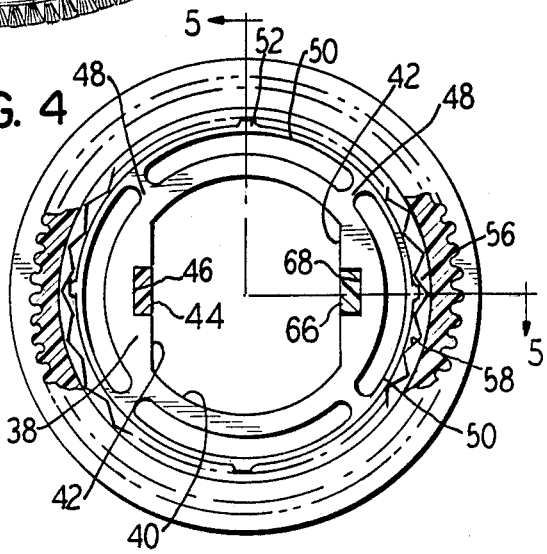
FIG. 4 is an end assembled view of the clutch mechanism taken generally along the line 4—4 of FIG. 5.
Figure 5:
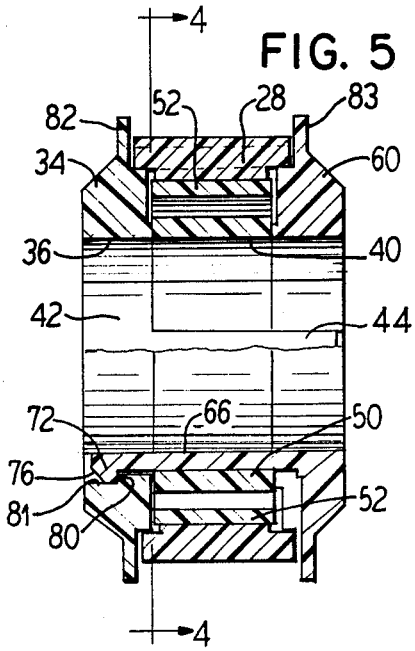
FIG. 5 is a side sectional view of the clutch mechanism taken generally along the line 5—5 of FIG. 4.

The clutch arrangement is best illustrated in FIGS. 3–5 where it is seen that the brush dowel 18 has a smaller shaft area 32 at one end thereof. The shaft 32 has a pair of flats 33 formed thereon for providing an anti-rotation keying function which is described in greater detail below. A first sprocket end cap 34 is provided which has a central opening 36 sized to be received on the shaft portion 32 including a pair of linear segments 37 corresponding to the flats 33 on the shaft portion 32. An inner cam member 38 which has a central opening 40 sized to be received on the shaft portion 32 is provided which also has a pair of linear portions 42 corresponding to the flats 33. The sprocket end cap 34 has a finger 44 projecting axially which extends through a recess 46 in the cam member 38.

As shown in FIG. 4, the inner cam member 38 has a plurality of radially extending spokes 48 which are connected at their outer ends by beams 50 which are relatively thin and somewhat flexible. Projecting radially outwardly from each of the beams 50 is at least one bump 52.

The sprocket 28 has an interior opening 54 sized to receive the cam member 38. The interior circumference of the sprocket 28 is comprised of a series of ridges or bumps 56 with valleys 58 therebetween. The bumps 52 of the cam member 38 are received in the sprocket valleys 58, however the sprocket ridges 56 are sufficiently tall to prevent relative rotation between the cam member 38 and the sprocket unless a sufficient amount of torque is applied to one while the other is held fixed as is explained further below.

A second sprocket end cap 60 is provided which has a central opening 62 sized to be received on the shaft 32 including a pair of linear segments 64 corresponding to the flats 33. The second sprocket end cap 60 is identical to the first end cap 34 and also has an axially extending finger 66 which extends through a second recess 68 in the cam member 38. Each of the fingers 44, 66 has a radially outwardly extending tang 70, 72 which includes a ramped surface 74, 76 on the side facing away from the end cap 34, 60 and a surface 78, 80 formed perpendicularly to the finger 44, 66. The fingers 44, 66 are preferably fabricated of a resilient material, and when the assembly of the two end caps 34, 60 and sandwiched sprocket 28 and cam member 38 are pressed axially together, the ramp surfaces 74, 76 will engage wall portions in the linear segments 42, 64 of the opposite end cap, the fingers will be bent radially inwardly permitting the tangs to pass along the wall portions and then the fingers will snap radially outwardly once the tangs 70, 72 have passed the wall portions into indented pockets 81 so that the entire assembly will be held together.

In such an assembly as shown in FIG. 5, the flat or linear segments of the interior openings will be held in alignment and can be carried on the shaft portion 32 aligned with the flats 33 thereof to prevent the end caps or cam member from rotating relative to the shaft. In this manner the cam member is keyed to the shaft. Further, the end caps each have a radially outwardly extending flange 82, 83 whcih serve to provide a lateral guide for the belt 26.

If the brush dowel is prevented from rotating, such as by a jam due to a sock or other article being engaged by the rotating brush dowel, the clutch assembly will slip between the cam member 38 and the sprocket 28 to prevent damage to the cog belt 26. The control circuitry for the vacuum sweeper 10 includes a control circuit to terminate operation of the motor in the event the sensed speed of the brush dowel drops below a predetermined low speed which would indicate a jamming of the brush.

The beams 50 of the cam 38 are sufficiently flexible and resilient to flex radially inwardly upon the application of a predetermined amount of torque between the cam 38 and the sprocket 28, for example the amount of torque applied by the motor to the sprocket with the cam held stationary due to a jammed brush dowel, so that the bumps 58 will be permitted to ride up the slopes of the ridges 56 and pass over the crests of the ridges before moving to the next valley 58. In this manner the energy and speed of the rotating sprocket is dissipated without the generation of excessive heat. The sprocket and inner cam may be fabricated of materials including silicone and Teflon additives to function as lubricants to facilitate relative movement between the cam and the sprocket in the event of a jam and to prevent excessive heat build up. Since the sprocket and cam yield and slip relative to one another, the parts continue to be usable after a jam has occurred.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

We claim as our invention:

1. In a vacuum cleaner, the combination comprising:

a brush dowel rotatably mounted to engage a floor surface to be cleaned;

an electric drive motor with an output shaft drivingly engageable with said brush towel to rotate said brush dowel about an axis;

a drive belt connecting said output shaft and said brush dowel providing said driving engagment;

a clutch mechanism on said brush dowel between said brush dowel and said drive belt to prevent damage to said drive belt if said brush dowel is restrained against rotation; said clutch mechanism including;

a pulley member mounted on said brush dowel for receiving said drive belt.

a cam member mounted on said brush dowel to corotate therewith;

said pulley member having an interior opening therein for receiving said cam member;

two end caps engageable to axially sandwich the asembly of said pulley member and said cam member therebetween;

said end cups each having an axially projecting finger of sufficient length to extend through the assembly of said cam and pulley and lockingly engage with the other of said end caps to provide a unitary assembly;

said cam member having a resilient outer surface which engages an interior surface of said pulley member;

said engaging surfaces being configured such that they engage in a torque transmitting manner to transmit sufficient torque from said drive belt to said brush dowel to cause said dowel to rotate against said floor surface, said outer surface of said cam member being sufficiently flexible to permit said configured surfaces to pass each other, thereby causing slippage therebetween when said dowel is held against rotation while said drive belt continues to rotate;

whereby, said pulley and said cam will provide sufficient slippage therebetween to prevent damage to said drive belt and brush dowel.

2. A device according to claim 1, wherein said pulley member comprises an annular ring-shaped member and said pulley interior surface includes a continuous series of alternating ridges whose peaks and valleys are axially oriented.

3. A device according to claim 2, wherein said cam member comprises a hub portion with radially extending spokes connected at their outer ends by beams forming said cam member outer surface, each beam having at least one bump projecting outwardly therefrom.

4. A device according to claim 3, wherein said beams are sufficiently resilient to permit said bumps to move radially inwardly when engaged by said pulley ridges upon the application of sufficient torque between said pulley and said cam.

5. A device according to claim 1, wherein said end caps each have a radially extending flange forming lateral guides for said drive belt.

6. A device according to claim 1, wherein said cam member and said pulley member are fabricated of a plastic material having a lubricating additive to enhance said slippage between said members.

7. In a vacuum cleaner a floor engaging brushing apparatus comprising:

a wheeled floor engaging housing for rolling over a floor surface to be cleaned;

an electric motor mounted in said housing and having an extending drive shaft with a sprocket-type driven pulley thereon;

a brush dowel rotatably mounted in said housing;

a sprocket member having an open center carried on said brush dowel;

a cog drive belt mounted on said sprocket-type pulley and said sprocket member to transmit a drive torque from said motor to said sprocket member;

a clutch mechanism positioned between said sprocket member and said brush dowel to transmit said drive torque from said sprocket member to said brush dowel;

said brush dowel having a removable end piece carried on a reduced diameter shaft portion of said brush dowel, said reduced diameter shaft portion having a flat keying area;

said clutch mechanism comprising:

a cam member keyed on said shaft portion to corotate therewith and having an outer diameter sized to fit within said central opening in said sprocket;

said sprocket opening defining an internal surface;

a cam member outer diameter defining an external resilient surface which is engageable with said internal surface of said sprocket;

said surfaces being configured such that they engage in a torque transmitting manner to transmit sufficient torque from said sprocket member to said brush dowel to cause said brush dowel to rotate against said floor surface, said outer surfaces of said cam member being sufficiently flexible to permit said configured surfaces to pass each other, thereby causing slippage therebetween when said dowel is held against rotation while said drive belt continues to rotate; whereby, said pulley and cam will provide sufficient slippage therebetween to prevent damage to said drive belt and brush dowel.

8. A device according to claim 7, wherein said sprocket member comprises an annular ring-shaped member and said sprocket internal surface includes a continuous series of alternating ridges whose peaks and valleys are axially oriented.

9. A device according to claim 8, wherein said cam member comprises a hub portion with radially extending spokes connected at their outer ends by beams forming said cam member outer surface, each beam having at least one bump projecting outwardly therefrom.

10. A device according to claim 9, wherein said beams are sufficiently resilient to permit said bumps to move radially inwardly when engaged by said sprocket ridges upon the application of sufficient torque between said pulley and said cam.

11. A device according to claim 7 including a pair of end caps engagable to axially sandwich the assembly of said sprocket member and said cam member therebetween.

12. A device according to claim 7, wherein said end caps each have an axially projecting finger of sufficient length to extend through the assembly of said cam and sprocket and lockingly engage with the other of said end caps to provide a unitary assembly.

13. A device according to claim 12, wherein said end caps each have a radially extending flange forming lateral guides for said drive belt.

14. A device according to claim 7, wherein said cam member and said pulley member are fabricated of a plastic material having a lubricating additive to enhance said slippage between said members.

* * * * *